US007770590B2

(12) United States Patent
Serden et al.

(10) Patent No.: US 7,770,590 B2
(45) Date of Patent: Aug. 10, 2010

(54) HOUSING HAVING AN EXPANSION TENT

(75) Inventors: Andreas Serden, Meersburg (DE); Martin Deister, Muehlhofen (DE); Peter Geiselhart, Meersburg (DE); Ingo Aust, Uhldingen-Muehlhofen (DE); Jan Krueder, Little Rock, AR (US)

(73) Assignee: EADS Deutschland GmbH, Ottobrunn (DE)

( * ) Notice: Subject to any disclaimer, the term of this patent is extended or adjusted under 35 U.S.C. 154(b) by 197 days.

(21) Appl. No.: 11/961,261

(22) Filed: Dec. 20, 2007

(65) Prior Publication Data

US 2008/0149156 A1 Jun. 26, 2008

(30) Foreign Application Priority Data

Dec. 23, 2006 (DE) ..... 10 2006 061 491

(51) Int. Cl.
*E04H 15/18* (2006.01)

(52) U.S. Cl. ..... 135/95; 135/96; 135/97; 52/2.13; 52/2.23

(58) Field of Classification Search ..... 135/87, 135/96, 97, 137, 116, 906, 908, 95; 52/1, 52/2.13–2.14, 2.17–2.18, 2.22–2.24; 5/413 M; 220/495.01
See application file for complete search history.

(56) References Cited

U.S. PATENT DOCUMENTS

| | | | | | |
|---|---|---|---|---|---|
| 2,955,606 | A * | 10/1960 | Walker | 52/2.21 |
| 3,150,670 | A * | 9/1964 | Bird et al. | 52/2.14 |
| 3,626,836 | A * | 12/1971 | Schneidler | 454/339 |
| 4,103,369 | A * | 8/1978 | Riordan | 52/2.14 |
| 4,109,424 | A * | 8/1978 | Block | 52/2.21 |
| 4,605,029 | A * | 8/1986 | Russell | 135/125 |
| 5,226,261 | A * | 7/1993 | Wilbourn et al. | 52/2.21 |
| 6,598,613 | B2 * | 7/2003 | Fritzche et al. | 135/124 |
| 6,875,119 | B2 * | 4/2005 | Murphy et al. | 472/134 |
| 6,986,178 | B2 * | 1/2006 | Turner | 5/413 R |
| 7,438,078 | B2 * | 10/2008 | Woodruff et al. | 135/96 |
| 2003/0019515 | A1 | 1/2003 | Fritzche et al. | |
| 2004/0031794 | A1 | 2/2004 | Bucher et al. | |

FOREIGN PATENT DOCUMENTS

| | | | |
|---|---|---|---|
| DE | 102 25 281 | C1 | 11/2003 |
| EP | 1229188 | A1 * | 8/2002 |
| EP | 1 273 743 | B1 | 1/2003 |
| EP | 1457623 | A2 | 9/2004 |
| GB | 496036 | | 11/1938 |
| JP | 04302677 | A * | 10/1992 |
| JP | 06292470 | A * | 10/1994 |

* cited by examiner

*Primary Examiner*—Winnie Yip
(74) *Attorney, Agent, or Firm*—Crowell & Moring, LLP

(57) ABSTRACT

A housing has an expansion tent connectable thereto. A bag-shaped cover is present, and has an opening permanently connected to the housing. The cover forms the interior surface of the erected expansion tent, and is suitable for hermetically sealing off the interior of the housing and the expansion tent with respect to the environment. Sealing can be provided during all operating conditions, while erecting the tent, and while dismantling the tent.

11 Claims, 7 Drawing Sheets a)

b)

a)

b)

a)

b)

a)

b)

c)

HOUSING HAVING AN EXPANSION TENT

This application claims the priority of German application 10 2006 061 491.7, filed Dec. 23, 2006, the disclosure of which is expressly incorporated by reference herein.

BACKGROUND AND SUMMARY OF THE INVENTION

This invention relates to a housing having an expansion tent that can be connected to the housing.

A housing in the sense of this invention may be a container, such as a 20' ISO standard container. Such containers are used as shelters for multiple applications, such as mobile hospital or command post applications.

A container of this type having an expansion tent is disclosed, for example, in European Patent Document EP 1 273 743 A1.

Particularly for medical applications, it is important to avoid contamination of the tent interior at any time, especially during erecting or dismantling of the expansion tent. Direct contact between the interior space and the exterior space should generally be avoided, so that the interior side remains on the inside and the exterior side remains on the outside (this is the so-called IN IN/OUT OUT effect).

It is an object of the invention to permit hermetic sealing-off of such an interior space with respect to the environment in all constructive conditions of the tent, particularly during tent erecting and dismantling, independently of the type of construction of the expansion tent.

This task is achieved by way of a bag-shaped cover, which, at its opening, is permanently connected to the housing, which forms an interior surface of the erected expansion tent, and which is suitable for hermetically sealing off interiors of the housing and the expansion tent with respect to the environment. These interiors are sealed off, in this manner, during all operating conditions, while erecting the tent, and while dismantling the tent. Advantageous embodiments are also claimed.

According to the invention, a bag-shaped cover is provided, which, by way of its opening, is permanently connected to the housing in all constructive conditions of the expansion tent. In the erected condition of the expansion tent, this bag-shaped cover forms the interior surface of the expansion tent. Together with the housing, the cover forms a closed boundary surface which separates the contaminated exterior space from the interior space to be kept clean. As a result, a hermetically tight interior space can also be maintained during tent erecting and dismantling.

The expansion tent may be constructed as one element; thus, it may be constructed in one piece with a tent surface. According to an embodiment of the invention, the expansion tent may also be divided in several tent segments, which together form the expansion tent. This is particularly useful when an expansion tent is required that has a fairly large floor space. The reason is that, because of its size and weight, handling would be difficult with a single-element construction. Erecting and dismantling would require additional devices, which increases the erecting and dismantling time. The present invention ensures that, with several tent segments, contact of the environment with the interior is avoided at any time.

To erect the expansion tent, the individual tent segments can first be erected and mutually connected. In the case of a single-element tent, the latter is erected. The bag-shaped cover connected to the housing opening can then be unfolded and fixed to the interior surface of the tent segments. The bag-shaped cover thereby forms the interior surface of the expansion tent over all tent segments.

In an advantageous embodiment, the bag-shaped cover is constructed such that it is self-supporting in the erected condition. It is also stable by itself, and does not have to be connected with the tent construction. For this purpose, fiberglass rods known from conventional camping tents may be used. During erection, these rods can be pushed, for example, into pockets existing in the cover. This embodiment has the additional advantage that a complete uncoupling of the tent and the cover is achieved. The tent can be erected or dismantled completely independently of the cover.

The invention has the following advantages.

The handling of fairly large tents (larger than 45 $m^2$) during erecting and dismantling, with a low personnel requirement, is permitted;

Hermetic sealing is provided during the erecting and dismantling operations;

Arbitrary commercially available tents of all types and construction principles can be used without adaptation or with only a slight adaptation; and The bag-shaped cover and the housing connected thereto form a closed boundary surface providing a permanent separation between a contaminated exterior space and an interior space that is to be kept clean (the IN IN/OUT OUT effect).

The bag-shaped cover also provides an improvement to the thermal protection of the tent.

In an advantageous embodiment of the invention, one of the tent segments is permanently connected with the bag-shaped cover. In this case, the bag-shaped cover is already flatly arranged on the inward-facing surface of the corresponding tent segment, and does not have to be connected during erection. This is accelerates erecting (analogously, the cover does not have to be detached again from the tent segment when the tent is dismantled). In addition, during erection of this tent segment, the bag-shaped cover is thereby simultaneously at least partially unfolded. The remaining tent segments are connected in a detachable manner with the bag-shaped cover only when erecting the tent, and are separated from one another again during dismantling. This connection between the cover and the tent segment can be eliminated with a self-supporting cover.

In a particularly advantageous embodiment of the invention, the bag-shaped cover is permanently connected with the tent segment that forms the closing segment at the end of the expansion tent away from the container. In this case, while erecting this tent segment, which is oriented away from the container, the bag-shaped cover is guided through the already erected tent segments, which are closer to the housing. As soon as the tent segment away from the container has been erected, the bag-shaped cover will also be completely unfolded and only still has to be fixed to the tent segment or to the remaining tent segments.

For erecting the expansion tent according to this embodiment, the individual tent segments, with the exception of the segment provided at the end away from the container, can be erected first and then connected with one another. Subsequently, the erection of the tent segment at the end away from the container takes place, the erection of the latter tent segment taking place together with the unfolding of the bag-shaped cover, specifically through the erected remaining tent segments. This cover then only has to be fixed to the interior surfaces of the remaining tent segments.

In a further embodiment of the invention, one of the tent segments itself forms a section of the bag-shaped cover. In this case, the tent segment must consist of a gastight material. This tent segment advantageously is the segment that is situated at the end of the expansion tent away from the container. The bag-shaped cover, therefore, consists of the corresponding tent segment, which forms the end of the tent away from the container, as well as a tube-shaped section, which, on one side, is gastightly connected to the above-mentioned tent segment and, on the other side, is gastightly connected to the housing.

To erect the expansion tent according to this embodiment, the individual tent segments, with the exception of the tent segment provided at the end away from the container, can first be erected and connected with one another. Subsequently, erection of the tent segment at the end away from the container takes place. Erection of the latter tent segment coincides with unfolding of the bag-shaped cover. In this case, erection takes place through the already erected tent segments. The cover then only has to be fixed to the interior surfaces of the remaining tent segments.

In the transport condition of the expansion tent, the tent segments and the bag-shaped cover are situated in a packed condition. These segments and the cover, for example, may be folded and rolled up inside the housing. Thus, a compact form is achieved, which protects the flexible, and therefore easily damageable, components of the expansion tent.

The expansion tent may be an inflatable tent. The following construction principles may be used here.

Air cells: Joined-together air-filled tubes whose exterior sides form the outer wall of the tent and whose interior sides form the interior wall. The tubes are connected with one another in the center, so that a hermetically closed wall structure is created in the center. The excess pressure in the tubes permits the omission of a supporting structure (no framing is required).

High-pressure beams: Tubes having an internal pressure greater than 1 bar inside the tent cover and having the purpose of absorbing forces acting upon the tent (frame replacement).

Low-pressure beams: Tubes having an internal pressure lower than 0.7 bar inside the tent cover and having the purpose of absorbing the forces acting upon the tent (frame replacement).

Other tent constructions, such as those with a bearing structure that is formed by a rod assembly, can also be used.

BRIEF DESCRIPTION OF THE DRAWINGS

The invention is described by way of two concrete embodiments with reference to the drawings.

FIG. 1*a* is a lateral view, and FIG. 1*b* is a top view, of both tent segments still in the completely packed condition;

FIG. 2*a* is a top view of the unfolded first tent segment;

FIG. 2*b* is a lateral view of the unfolded first tent segment;

FIG. 3*a* is a top view of the inflated first tent segment;

FIG. 3*b* is a lateral view of the inflated first tent segment;

FIG. 3*c* is a front view of the inflated first tent segment;

FIG. 4*a* is a top view of the unfolded second tent segment;

FIG. 4*b* is a lateral view of the unfolded second tent segment;

FIG. 5*a* is a top view of the partially inflated second tent segment;

FIG. 5*b* is a lateral view of the partially inflated second tent segment;

FIG. 6*a* is a lateral view of the completely inflated second tent segment;

FIG. 6*b* is a front view of the completely inflated second tent segment.

FIG. 7 is a lateral view of the partially inflated second tent segment in the second embodiment.

DETAILED DESCRIPTION OF THE INVENTION

Figure 1:
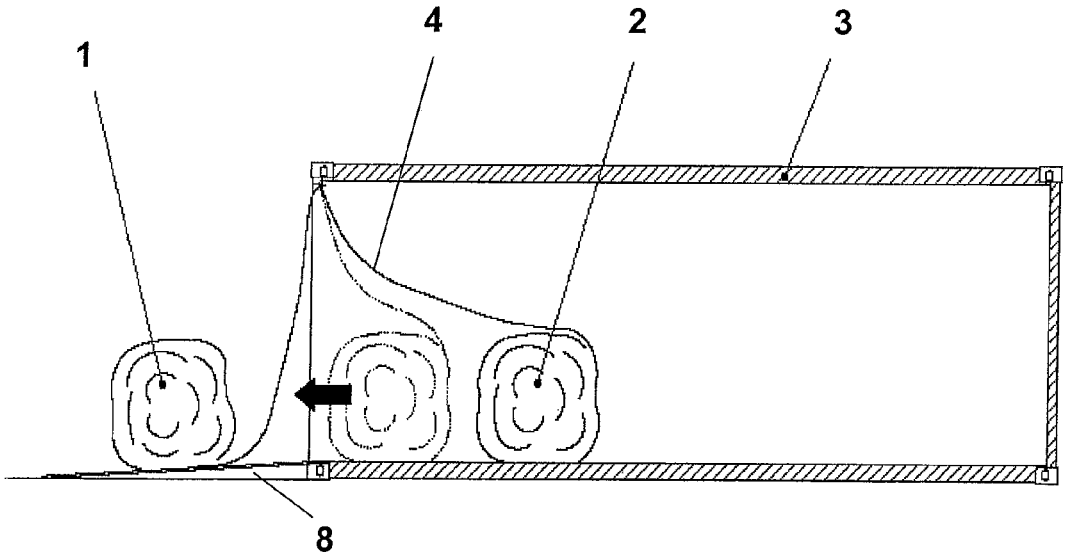
FIGS. 1 to 6 are consecutive snapshots during erection of the first embodiment.
Figure 1:
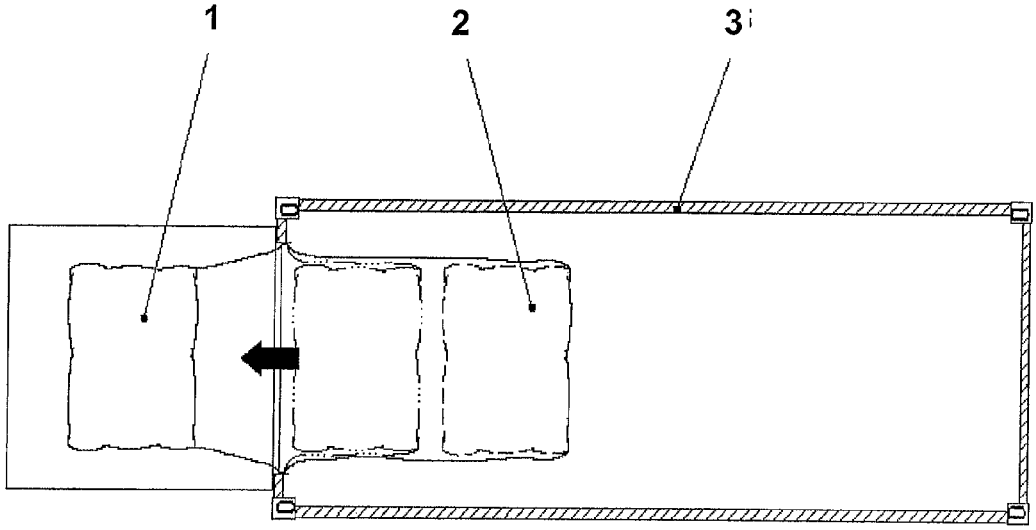

FIG. 1 shows the initial condition (transport condition) during erection of the expansion tent of a housing, which is constructed here as an ISO standard container. The space formed by the tent and the container may be used, for example, for a mobile hospital or a command post.

The container 3 has the shape of a cuboid and has firm walls made, for example, of steel or plastic. A multilayer construction consisting of base and cover layers, with an intermediate layer made of an insulating material, is also conceivable, as known, for example, from German Patent Document DE 102 25 281 C2. An expansion tent is to be built onto one side of the container (here, the shorter side). In this embodiment, the tent consists of exactly two tent segments. The division of the expansion tent into individual tent segments takes place perpendicular to the ridge line. Each of the individual tent segments may be erected by itself, independently of the other tent segment. They are then coupled at their gable ends. The erection therefore takes place along a direction defined by the roof ridge.

In the initial condition according to FIG. 1, the two tent segments 1, 2 are housed in the container in the packed condition (folded and rolled up). The tent segment 1 is shown by broken line in this position (see FIG. 1*a*). The segments consist of a flexible material.

After opening the front flap 8 of the container, the first tent segment 1, which is close to the container, is rolled out of the container. In the erected condition of the expansion tent, this tent segment is situated directly adjacent to the container. It is advantageously permanently connected to the container along the entire circumference of the container opening. However, this permanent linkage can also be omitted.

Figure 2:
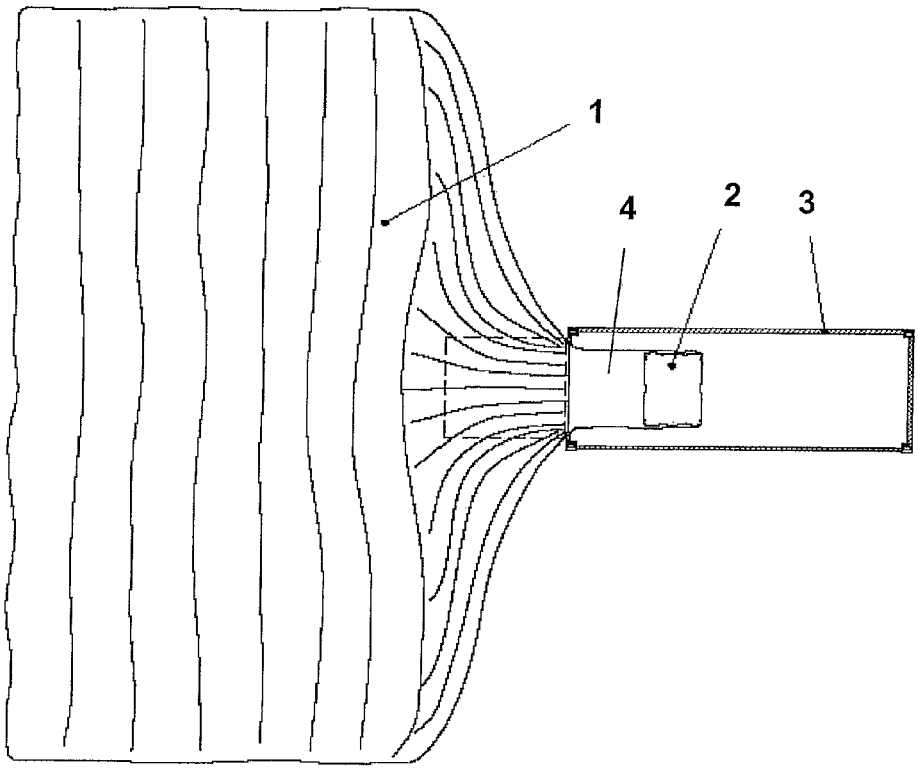
Figure 2:
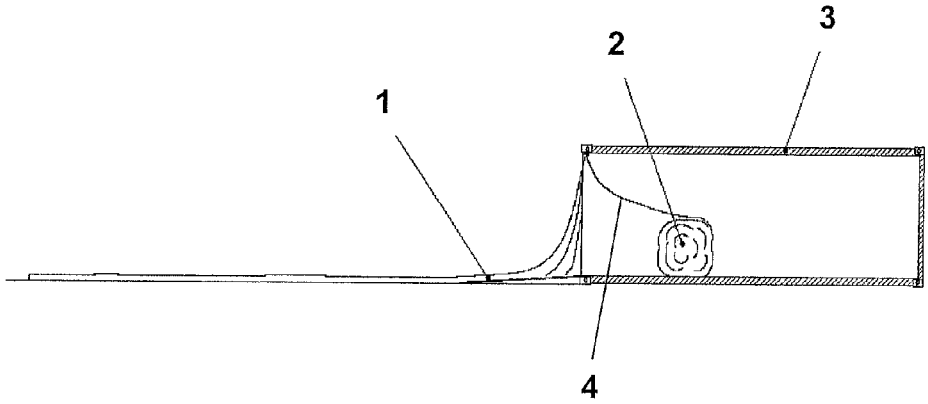

FIG. 2 shows a situation in which the tent segment 1 is completely rolled out and unfolded. Like the tent segment 2, the tent segment 1 consists of individual tube-type parallel chambers (air cells), respectively adjacent air cells communicating with one another by way of openings.

Figure 3:
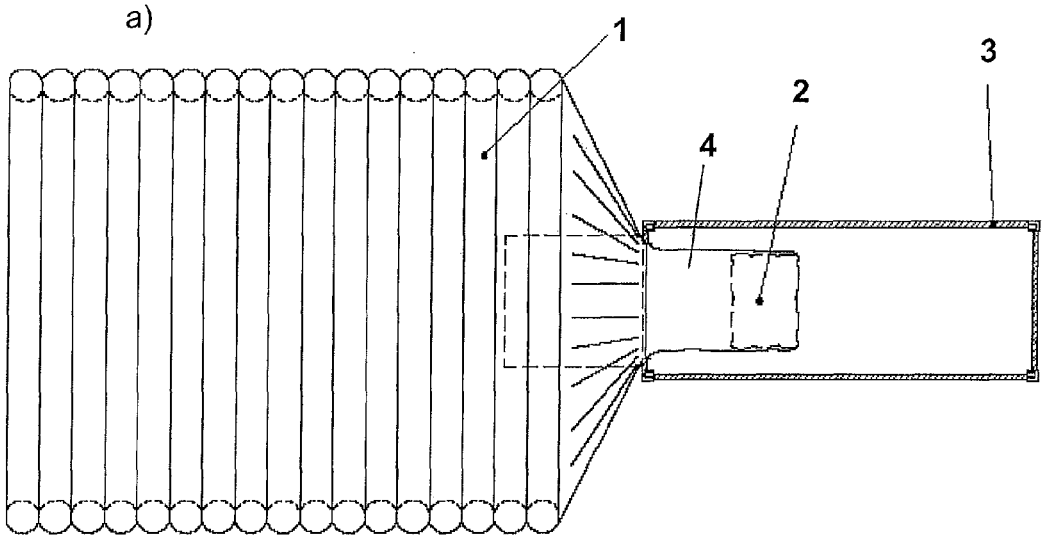
Figure 3:
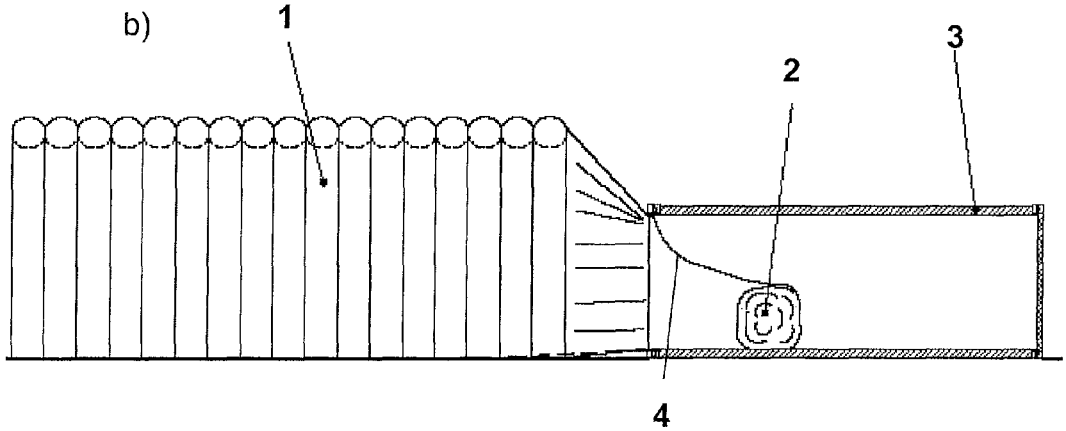
Figure 3:
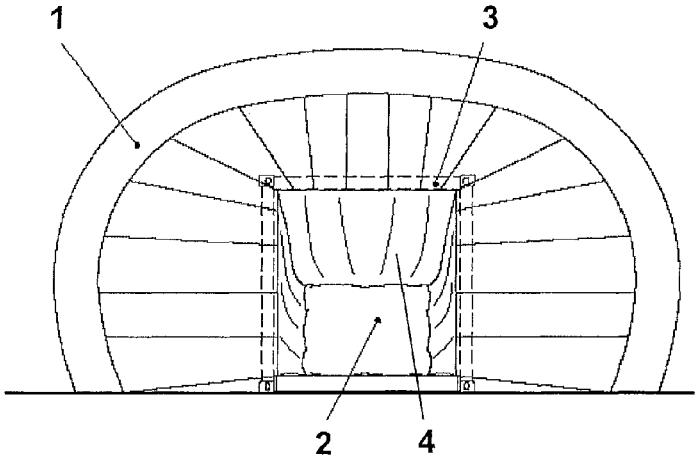

In FIG. 3, the first tent segment 1 is completely inflated. As illustrated in the front view according to FIG. 3*c*, this first tent segment 1 is open toward the front, beyond the container. There, the second tent segment 2, which is still situated in the container 3, can be connected.

A bag-shaped cover 4 is provided according to the invention. It consists of a gastight flexible material. With respect to the size and the blank, the cover is adapted to the expansion tent such that, in the erected condition, it can form the closed and tight interior surface of the entire expansion tent. It has precisely one opening at which it is gastightly connected to the container 3 along the circumference of the container opening. Together with the walls of the container 3, the cover 4 forms the boundary surface between the contaminated exterior area and the interior area to be kept clean.

Figure 4:
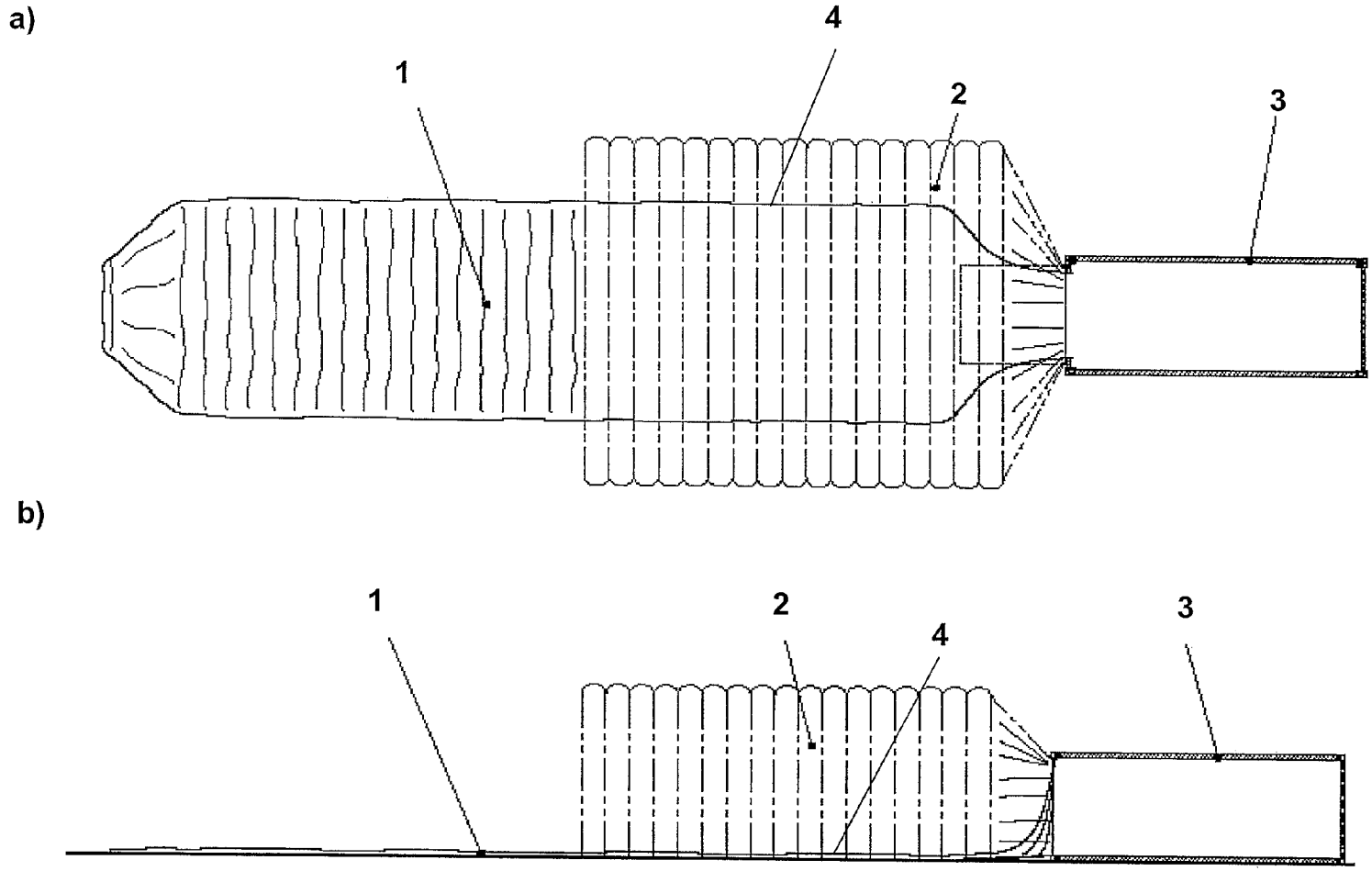

In the illustrated advantageous embodiment, the cover 4 is permanently and flatly connected with the tent segment 2 away from the container, specifically on the surface which, in the erected condition of the tent segment 2, forms the inward-facing surface. This fastening of the cover to the tent segment 2 has the effect that, as a result of the rolling-out and unfolding of the tent segment (FIG. 4) away from the container, the cover 4 connected with the latter is also rolled out and unfolded. The rolling-out of the disassembled tent segment 2, away from the container, together with the cover 4 arranged thereon, takes place through the already erected tent segment 1 close to the container.

In an embodiment not shown here, the bag-shaped cover is connected with none of the tent segments in the transport condition. In this case, the individual tent segments are first erected and mutually connected. Subsequently, the unfolding of the bag-shaped cover takes place in the interior of the tent over all tent segments, so that the cover forms the interior surface of the expansion tent.

Figure 5:
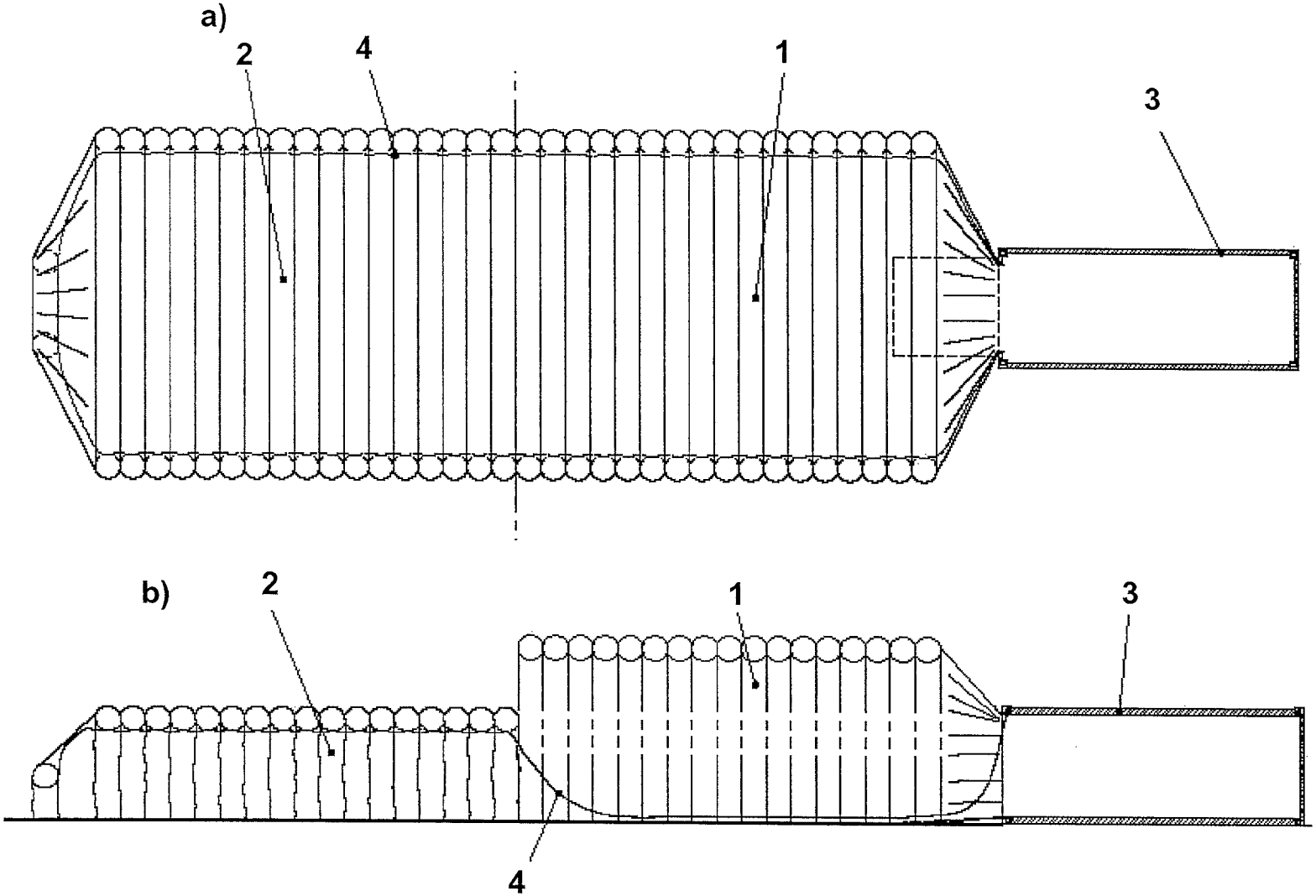

In FIG. 5, the tent segment 2 away from the container is partially inflated. The cover 4 is flatly connected with the tent segment 2, specifically on its entire inward-facing side. It is also shown in FIG. 5 that, in the area of the tent segment 1 close to the container, the cover 4 is still hanging through—and is therefore, at this point in time of the erecting operation as well as generally in the transport condition, not yet connected with the tent segment close to the container.

Figure 6:
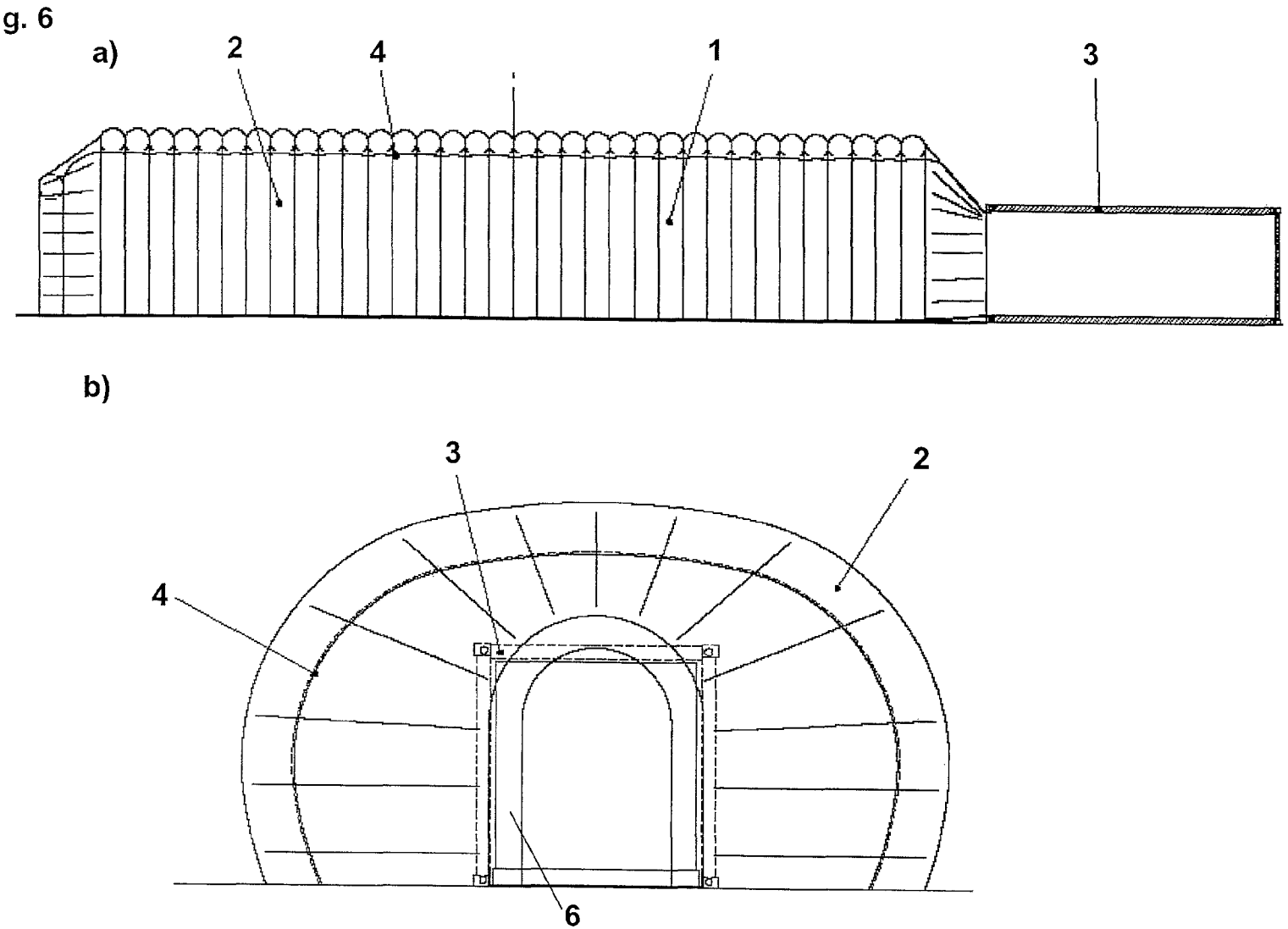

In FIG. 6, the exterior tent segment 2 is now also completely inflated and is connected with the tent segment 1 close to the container at the gable sides (for example, by tightening straps which, at the coupling point, reach around the mutually abutting air cells of the two tent segments 1,2). In the area of the tent segment 1 close to the container, the cover 4 is fastened to the interior side, for example, by means of a velcro fastener, a tightening strap, or other fastening device(s). The cover 4 can thereby also contribute to improved heat insulation. As illustrated in the front view according to FIG. 6*c*, the tent segment 2 away from the container comprises an essentially vertical wall, which forms the face side of the expansion tent. An adapter 6 for the connection of another tent or as an emergency exit is provided at this face side. At a corresponding point, for example, a gastight zipper may be arranged at the bag-shaped cover 4, which zipper provides the passage way.

Figure 7:
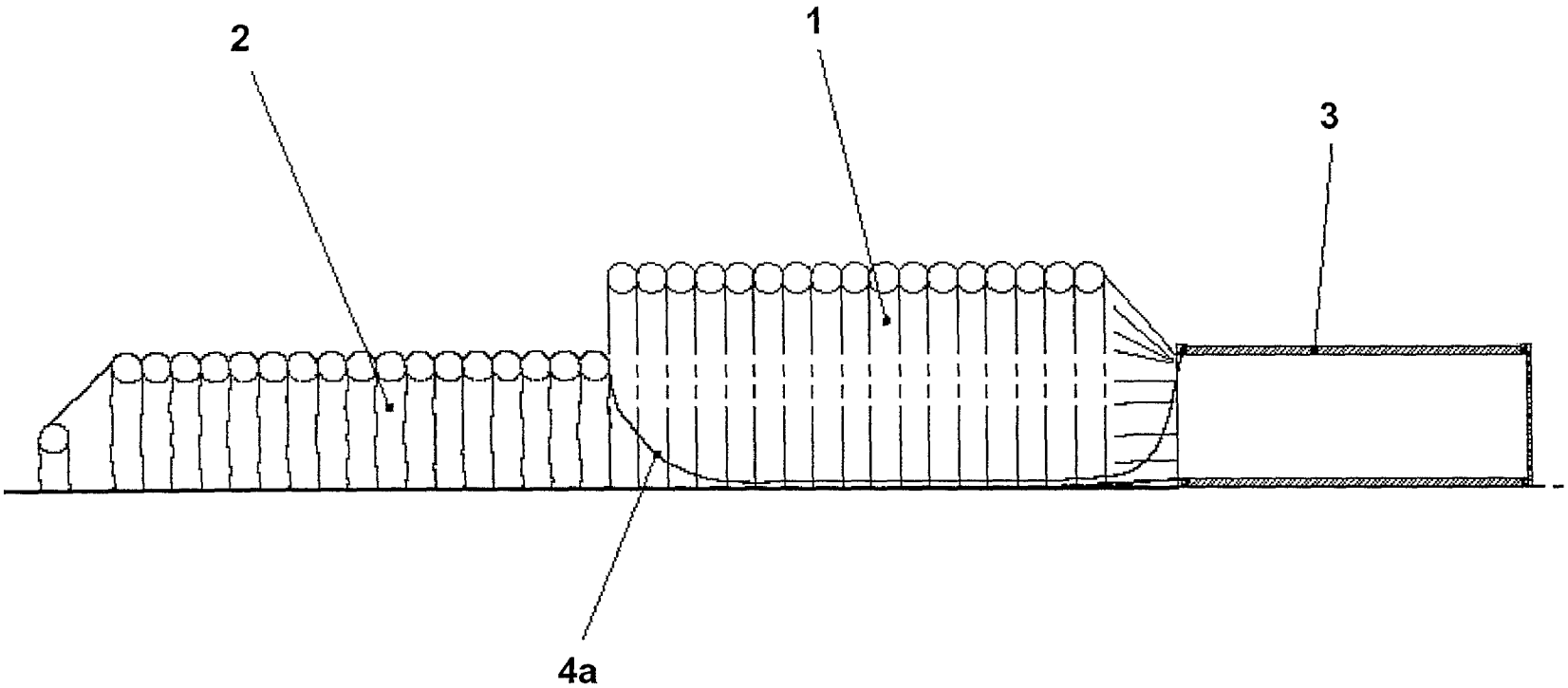
FIG. 7 is a snapshot during erection of the second embodiment.

FIG. 7 is a snapshot during the erection of a second embodiment of the expansion tent according to the invention on a container. It shows a situation which corresponds to FIG. 5 for the first embodiment. The tent 1 close to the container is already completely erected. The tent 2 away from the container is only partially inflated.

However, in the embodiment according to FIG. 7, the tent segment 2, which is away from the container, itself forms a part of the bag-type cover. For this purpose, the tent segment away from the container consists of a gastight material. At a gable side, it is gastightly connected over its entire cross-sectional circumference with a tube-shaped cover 4*a*. At its other end, the tube-shaped cover 4*a* is gastightly connected with the housing 3. It is therefore situated inside the tent segment 1 close to the container. The bag-type cover, which prevents contamination of the interior in all constructive conditions, in this embodiment, is formed by the combination of the tent segment 2 away from the container and the tube-shaped section 4*a*. The erection of this embodiment otherwise takes place as described in FIGS. 1 to 6 for the first embodiment.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. A device comprising:

a housing or container, an expansion tent, comprising at least two tent segments, connectable to the housing or container, and a bag-shaped cover, which, at its opening, is permanently connected to the housing or container, which forms an complete interior surface of the erected expansion tent, and which is suitable for hermetically sealing off interiors of the housing or container and the expansion tent with respect to the environment during all operating conditions, while erecting the tent, and while dismantling the tent, wherein the at least two tent segments and the bag-shaped cover are situated inside the house or container in a disassembly condition of the expansion tent, and are expanded outside of the house or container in an expanded or erected condition, wherein only one of the tent segments is permanently connected with the bag-shaped cover, wherein the tent segment permanently connected with the bag-shaped cover is a segment that is provided for an end of the expansion tent away from the housing or container in the expanded and erected condition, and wherein, in the expanded or erected condition, the two tent segments are connected together, and in the disassembled condition of the expansion tent, the tent segments are separated from each other.

2. The device according to claim 1, wherein, in an erected condition, the bag-shaped cover has a self-supporting construction.

3. The device according to claim 2, wherein one of the tent segments is permanently connected with the bag-shaped cover such that the bag-shaped cover is flatly arranged on the surface of the tent segment that faces inward in the erected condition.

4. The device according to claim 2, wherein the bag-shaped cover is formed by one of the tent segments together with a tube-shaped cover connected thereto.

5. The device according to claim 2, wherein the expansion tent is an inflatable tent.

6. The device according to claim 1, wherein said one of the tent segments is permanently connected with the bag-shaped cover such that the bag-shaped cover is flatly arranged on the surface of the tent segment that faces inward in the erected condition.

7. The device according to claim 6, wherein the expansion tent is an inflatable tent.

8. The device according to claim 1, wherein the bag-shaped cover is formed by one of the tent segments, which is provided for an end of the expansion tent away from the housing or container, together with a tube-shaped cover connected thereto.

9. The device according to claim 8, wherein the expansion tent is an inflatable tent.

10. The device according to claim 1, wherein the expansion tent is an inflatable tent.

11. A device comprising:

a housing or container, an expansion tent, comprising at least two tent segments, connectable to the housing or container, and a bag-shaped cover, which, at its opening, is permanently connected to the housing or container, which forms the complete interior surface of the erected expansion tent, and which is suitable for hermetically sealing off interiors of the housing or container and the expansion tent with respect to the environment during all operating conditions, while erecting the tent, and while dismantling the tent, wherein the at least two tent segments and the bag-shaped cover are situated inside the house or container in a disassembly condition of the expansion tent, and are expanded outside of the house or container in a expanded or erected condition, wherein, at least one of the tent segments is permanently connected with the bag-shaped cover in the expanded or erected condition, wherein, in the expanded or erected condition, the two tent segments are connected together, and in the disassembled condition of the expansion tent, the bag-shaped cover is not connected with any of the at least two tent segments and the at least two tent segments are separated from each other.

* * * * *